US007063152B2

(12) United States Patent
Yeo et al.

(10) Patent No.: US 7,063,152 B2
(45) Date of Patent: Jun. 20, 2006

(54) MODEL HCCV HYDROSTATIC CLOSED CIRCULATION VALVE

(75) Inventors: Joseph C. H. Yeo, Singapore (SG); Anthony J. Orchard, Bangkok (TH); Keith E. Lewis, Bangkok (TH); Christopher L. Weaver, Kuala Lumpur (ML)

(73) Assignee: Baker Hughes Incorporated, Houston, TX (US)

( * ) Notice: Subject to any disclaimer, the term of this patent is extended or adjusted under 35 U.S.C. 154(b) by 152 days.

(21) Appl. No.: 10/676,243

(22) Filed: Oct. 1, 2003

(65) Prior Publication Data

US 2005/0072575 A1 Apr. 7, 2005

(51) Int. Cl.
*E21B 43/00* (2006.01)

(52) U.S. Cl. ..... 166/285; 166/372; 166/317

(58) Field of Classification Search ..... 166/265, 166/372, 177.7, 153, 317
See application file for complete search history.

(56) References Cited

U.S. PATENT DOCUMENTS

| | | | | |
|---|---|---|---|---|
| 4,188,999 | A | 2/1980 | Amancharla | 166/133 |
| 4,469,173 | A | 9/1984 | Gilbert et al. | 166/188 |
| 5,178,216 | A | 1/1993 | Giroux et al. | 166/242 |
| 5,188,183 | A | 2/1993 | Hopmann et al. | 166/387 |
| 5,479,986 | A | 1/1996 | Gano et al. | 166/292 |
| 6,109,354 | A | 8/2000 | Ringgenberg et al. | 166/374 |
| 6,145,595 | A | 11/2000 | Burris, II | 166/374 |
| 6,230,811 | B1 * | 5/2001 | Ringgenberg et al. | 166/374 |
| 6,286,594 | B1 * | 9/2001 | French | 166/151 |
| 6,328,055 | B1 | 12/2001 | Burris, II | 137/68.23 |
| 6,397,949 | B1 | 6/2002 | Walker et al. | 166/374 |
| 2003/0221837 | A1 * | 12/2003 | Giroux et al. | 166/373 |
| 2004/0112606 | A1 * | 6/2004 | Lewis et al. | 166/372 |
| 2004/0154798 | A1 * | 8/2004 | Vincent et al. | 166/291 |

FOREIGN PATENT DOCUMENTS

| | | |
|---|---|---|
| EP | 0581533 | 2/2004 |
| EP | 0585097 | 2/2004 |

* cited by examiner

*Primary Examiner*—William Neuder
(74) *Attorney, Agent, or Firm*—Madan, Mossman & Sriram P.C.

(57) ABSTRACT

Devices and methods for methods for cleaning of excess cement from a production assembly as well as from the annulus surrounding the production assembly. A hydrostatic closed circulation valve (HCCV) assembly is described that is primarily actuatable between open and closed positions by varying hydraulic pressure in the flowbore of the production assembly. The valve assembly is useful for selectively circulating working fluid into the annulus from the flowbore of the production assembly.

21 Claim, 7 Drawing Sheets

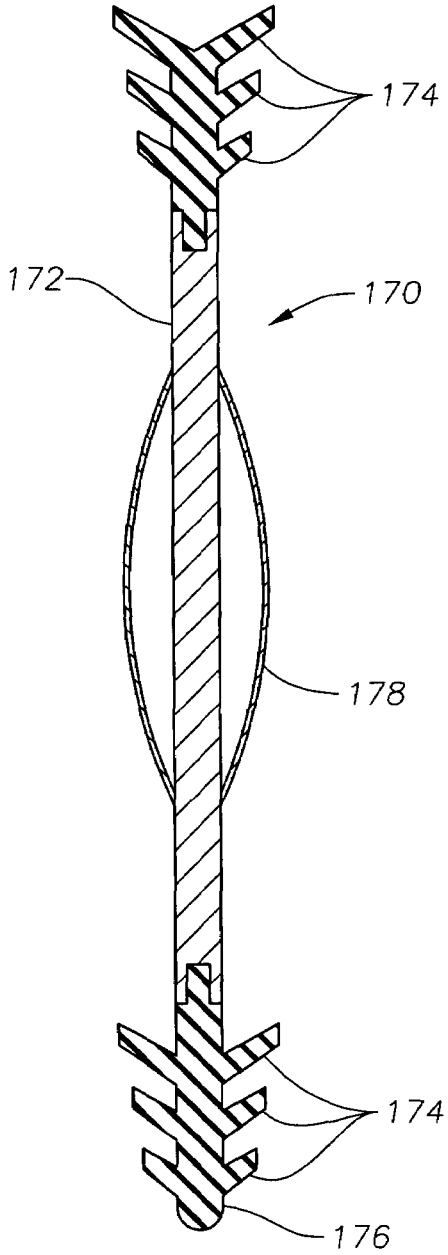
Fig. 11
Fig. 12
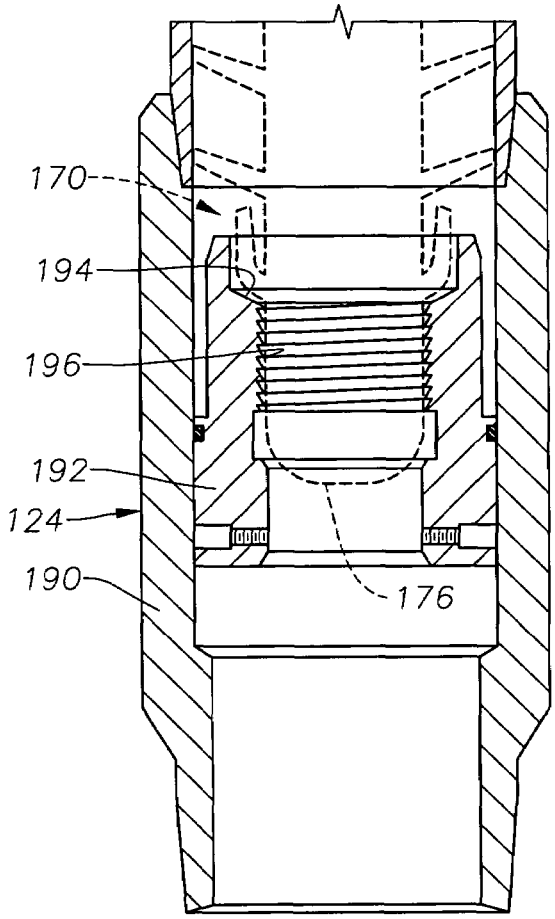

MODEL HCCV HYDROSTATIC CLOSED CIRCULATION VALVE

BACKGROUND OF THE INVENTION

1. Field of the Invention

The invention relates generally to valve assemblies useful in well completions wherein it is desired to cement in a portion of a production liner and, thereafter, utilize gas lift technology to assist production of fluids from a well.

2. Description of the Related Art

After a well is drilled, cased, and perforated, it is necessary to anchor a production liner into the wellbore and, thereafter, to begin production of hydrocarbons. Oftentimes, it is desired to anchor the production liner into place using cement. Unfortunately, cementing a production liner into place within a wellbore has been seen as foreclosing the possibility of using gas lift technology to increase or extend production from the well in a later stage. In addition, cementing is of the production liner may make it difficult to produce hydrocarbons in a standard manner, without artificial lift. Excess cement may clog portions of the flowbore of the production system. Cementing the production liner into place prevents the production liner from being withdrawn from the well. Because a completion becomes permanent when the production liner is cemented, any gas lift mandrels that are to be used will have to be run in with the production string originally. This is problematic, though, since the operation of cementing the production liner into the wellbore tends to leave the gas inlets of a gas lift mandrel clogged with cement and thereafter unusable. Additionally, the annulus above the cemented portion may contain excess cement that would hamper the ability to transmit gas down to the gas lift valves via the annulus. To date, there is no satisfactory method known for cleaning cement from the annulus surrounding the production assembly.

The present invention addresses the problems of the prior art.

SUMMARY OF THE INVENTION

The invention provides devices and methods for cleaning of excess cement from a production assembly as well as from the annulus surrounding the production assembly. A hydrostatic closed circulation valve (HCCV) assembly is described that is primarily actuatable between open and closed positions by varying hydraulic pressure in the flowbore of the production assembly. The valve assembly is useful for selectively circulating working fluid into the annulus from the flowbore of the production assembly.

In a preferred embodiment, the HCCV assembly includes a tubular inner mandrel having a lateral fluid flow port. The inner mandrel has threaded axial ends for incorporation into a production assembly. The lateral flow port is initially closed to fluid flow port by a frangible rupture member. The valve assembly is also provided with an outer sleeve that is axially moveable upon the inner mandrel between the original, first position, wherein the flow port is substantially not blocked against fluid flow, and a final, second position, wherein the outer sleeve does substantially block flow of fluid through the flow port.

The valve assembly is also provided with an inner sleeve that is axially moveable within the inner mandrel. The inner sleeve serves as a backup means for selectively closing the fluid flow port against fluid flow. The inner sleeve is moveable by mechanical means, such as a wireline-run shifting tool.

In operation, the HCCV valve assembly is incorporated into a completion system that is secured within a wellbore by cementing. Following the cementing operation, a well working fluid for cleaning of excess cement is flowed into the flowbore of the completion system. The valve assembly is opened upon application of fluid pressure within the flowbore that is sufficient to rupture the rupture member in the valve assembly. Working fluid is then circulated through the valve assembly. Upon application of a second, increased level of fluid pressure within the flowbore and annulus, the outer sleeve of the valve assembly is shifted to its closed position, thereby closing off fluid communication between the flowbore and the annulus. In the event that the outer sleeve does not close, a wireline shifting tool may be disposed down the flowbore to engage the inner sleeve of the valve assembly and close it.

BRIEF DESCRIPTION OF THE DRAWINGS

FIG. 11 depicts an exemplary wiper plug device used with the completion system shown in FIGS. 4–10.

FIG. 12 is a detail view showing seating of the wiper plug within the landing collar.

DETAILED DESCRIPTION OF THE PREFERRED EMBODIMENTS

Figure 1:
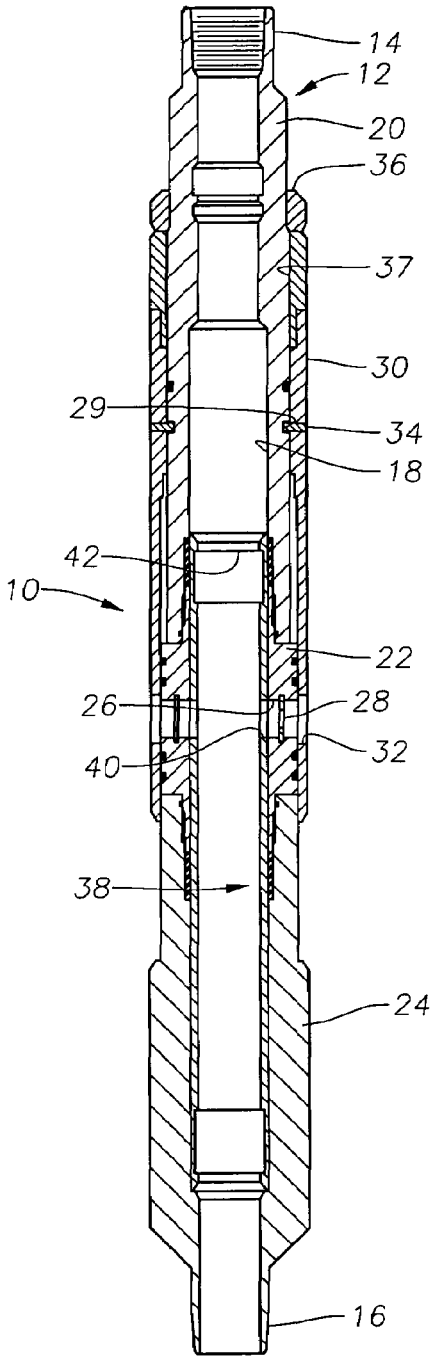
FIG. 1 is a side, cross-sectional view of an exemplary hydrostatic closed circulation valve assembly constructed in accordance with the present invention.
Figure 2:
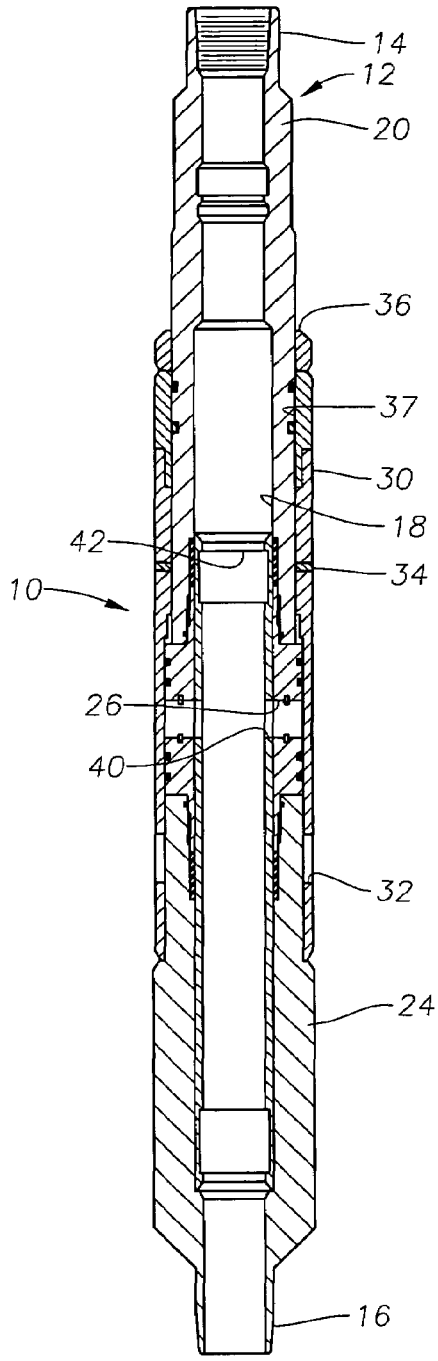
FIG. 2 is a side, cross-sectional view of the valve assembly depicted in FIG. 1 with the outer sleeve in a closed position.
Figure 3:
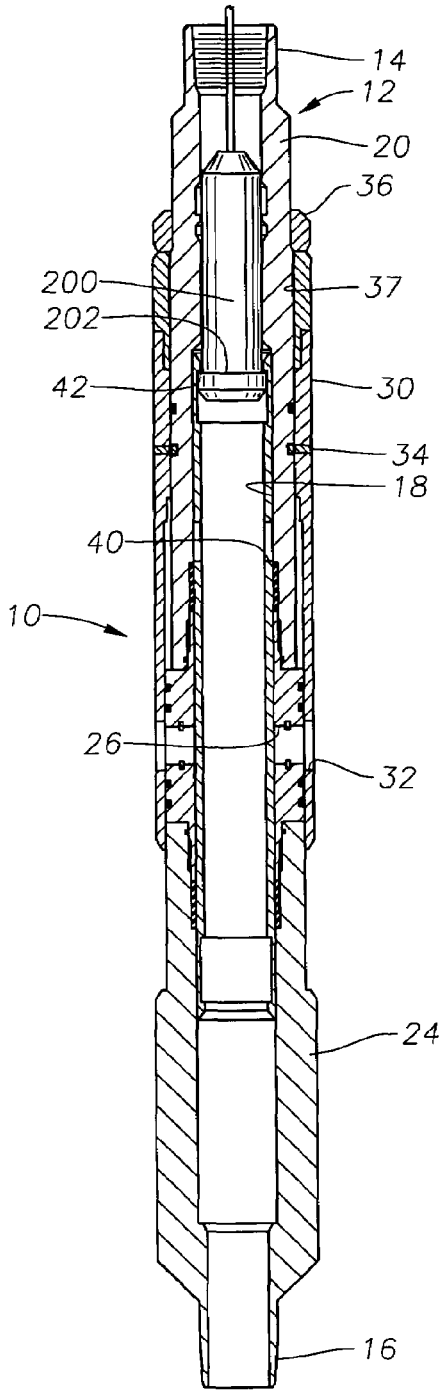
FIG. 3 is a side cross-sectional view of the valve assembly depicted in FIGS. 1 and 2 with the inner sleeve now in a closed position.

FIGS. 1–3 illustrate a hydrostatic closed circulation valve (HCCV) 10 constructed in accordance with the present invention. The HCCV 10 includes an inner mandrel 12 having threaded pin and box-type connections at either axial end 14, 16. The inner mandrel 12 defines an axial flowbore 18 along its length. The inner mandrel 12 may be a unitary piece or, alternatively, made up of a series of components that are in threaded connection with one another, as illustrated in FIG. 1. An upper sub 20 is affixed to a central sleeve 22. In turn, the central sleeve 22 is secured at its lower end to a lower sub 24. The central sleeve 22 of the inner mandrel 12 contains a lateral fluid flow port 26 through which fluid communication may occur between the flowbore 18 and the radial exterior of the inner mandrel 12. Initially, a frangible rupture member, such as rupture disk 28, closes the fluid port 26 against fluid flow. The rupture disk 28 is designed to break away upon the application of a predetermined fluid pressure differential, for example 4,500 psi. A snap ring 29 radially surrounds the inner mandrel 12 and resides within a complimentary groove in the surface of the inner mandrel 12.

An outer sleeve 30 radially surrounds the inner mandrel 12 and is capable of axial movement upon the inner mandrel 12. A fluid opening 32 is disposed through the outer sleeve 30. A frangible shear pin 34 secures the outer sleeve 30 to the inner mandrel 12. Additionally, the upper end 36 of the outer sleeve 30 provides a pressure receiving area. Below the upper end 36, is a radially interior relief 37 that is shaped and sized to engage the snap ring 29 when the outer sleeve 30 has been moved to a closed position (FIG. 2).

The HCCV 10 also includes an inner sleeve 38 that is located within the flowbore 18 of the inner mandrel 12. The inner sleeve 38 features a fluid aperture 40 that is initially aligned with the fluid opening 26 in the inner mandrel 12. The upper end of the inner sleeve 38 provides an engagement profile 42 that is shaped to interlock with a complimentary shifting element. The inner sleeve 38 is also axially moveable within the flowbore 18 between the initial, first position, shown in FIG. 1, wherein the fluid aperture 40 is aligned with the lateral fluid flow port 26 of the inner mandrel 12, and a second position (shown in FIG. 3) wherein the fluid aperture 40 is not aligned with the flow port 26. When the inner sleeve 38 is in the second position, fluid communication between the flowbore 18 and the exterior radial surface of the valve assembly 10 is blocked.

The HCCV valve assembly 10 is integrated into a completion assembly that is run into a wellbore and is used to produce hydrocarbon fluids thereafter from the wellbore. The valve assembly 10 is particularly useful for completions wherein a production liner portion of the completion assembly is cemented in place within the wellbore. As part of a cleaning process, the valve assembly 10 can be selectively opened and closed to flow a well working fluid into the annulus surrounding the completion assembly and, thereby, clean excess cement from the annulus as well as the interior of the completion assembly. The valve assembly 10 can then be selectively closed when cleaning is complete in order to produce hydrocarbons through the flowbore of the completion assembly.

Figure 4:
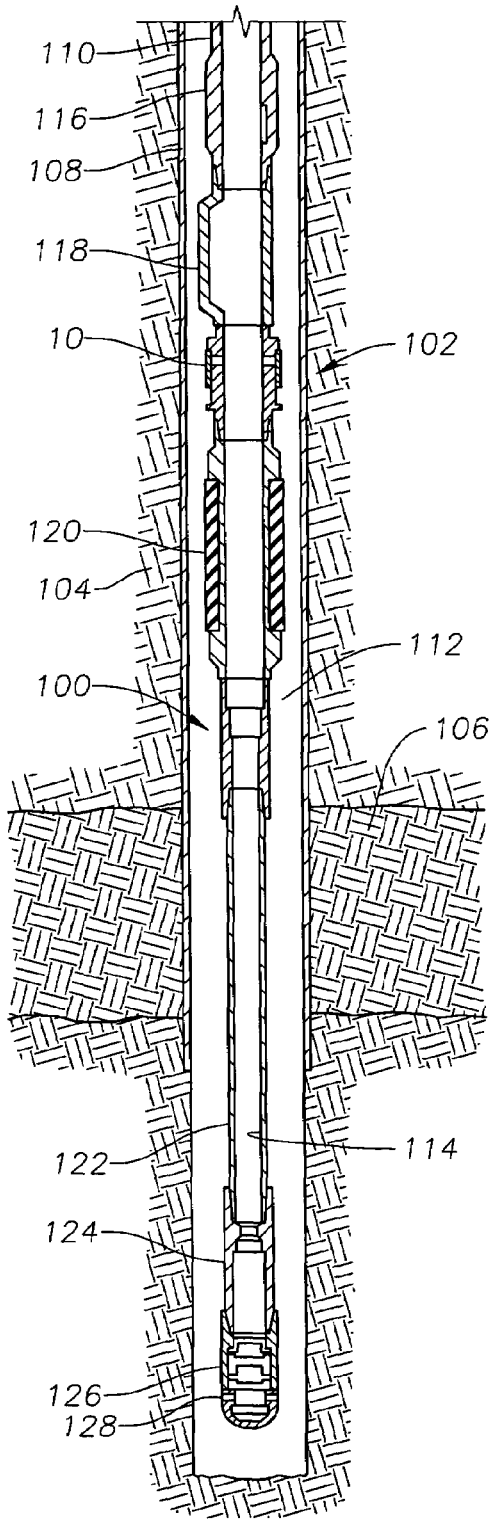
FIG. 4 is a side, cross-sectional view of an exemplary completion system that incorporates the hydrostatic closed circulation valve depicted in FIGS. 1–3.
Figure 5:
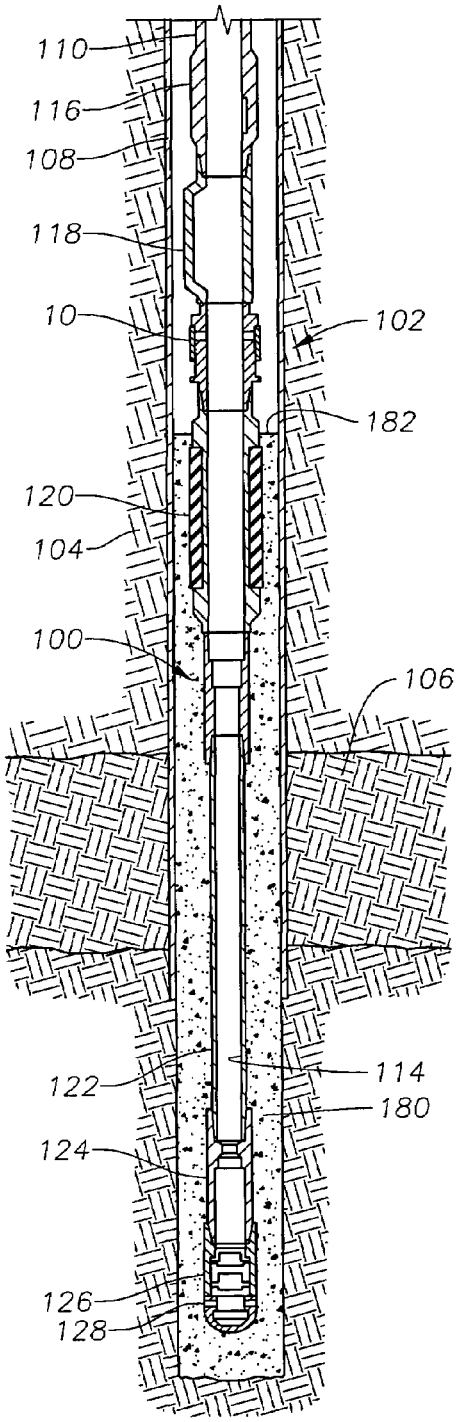
FIG. 5 is a side, cross-sectional view of the completion system shown in FIG. 4, following flowing of cement into the annulus.

To aid in explanation of the valve assembly 10 and its operation, FIGS. 4–10 illustrate the structure and operation of an exemplary completion assembly 100, which incorporates the valve assembly 10 therein. FIG. 4 depicts a wellbore 102 that has been drilled into the earth 104. A hydrocarbon formation 106 is illustrated. The exemplary wellbore 102 is at least partially cased by metal casing 108 that has been previously cemented into place, as is well known. An exemplary completion system or assembly, illustrated generally at 100, is shown suspended from production tubing 110 and disposed within the wellbore 102. An annulus 112 is defined between the completion system 100 and the wellbore 102. In addition, it is noted that the production tubing 110 and the completion system 100 define therewithin an axial flowbore 114 along their length.

The upper portions of the exemplary completion system 100 include a number of components that are interconnected with one another via intermediate subs. These components include a subsurface safety valve 116, a side-pocket mandrel 118, and the hydrostatic closed circulation valve (HCCV) assembly 10. A packer assembly 120 is located below the HCCV assembly 10. A production liner 122 extends below the packer assembly 120 and is secured, at its lower end, to a landing collar 124. A shoe track 126 is secured at the lower end of the completion system 100. The shoe track 126 has a plurality of lateral openings 128 that permit cement to be flowed out of the lower end of the flowbore 114 and into the annulus 112.

The subsurface safety valve 116 is a valve of a type known in the art for shutting off the well in case of emergency. As the structure and operation of such valves are well understood by those of skill in the art, they will not be described in any detail herein.

Figure 13:
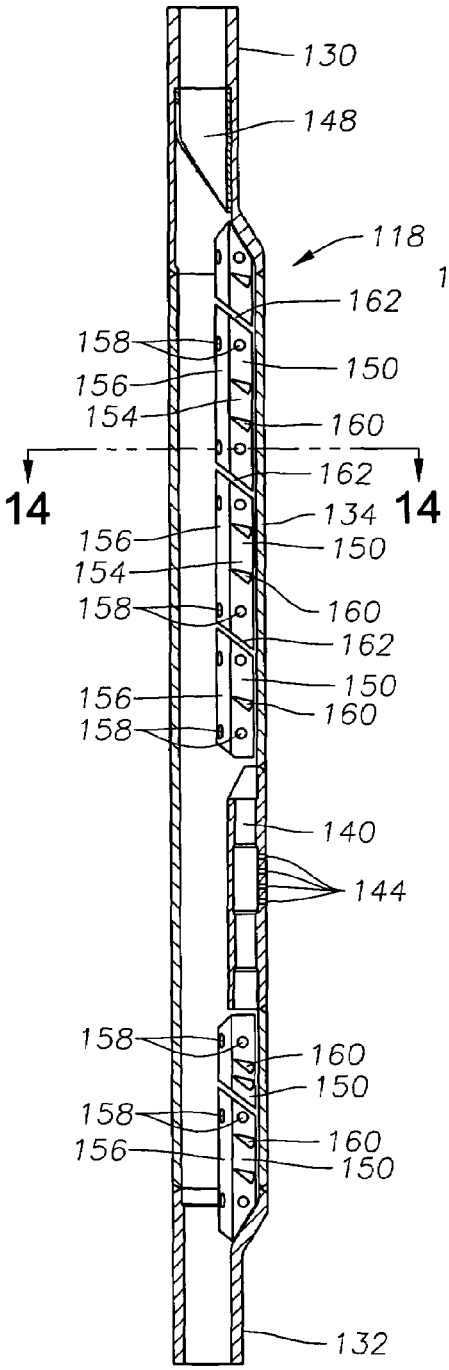
FIG. 13 is a cross-sectional depiction of an exemplary side-pocket mandrel used in the completion system shown in FIGS. 4–10.
Figure 14:
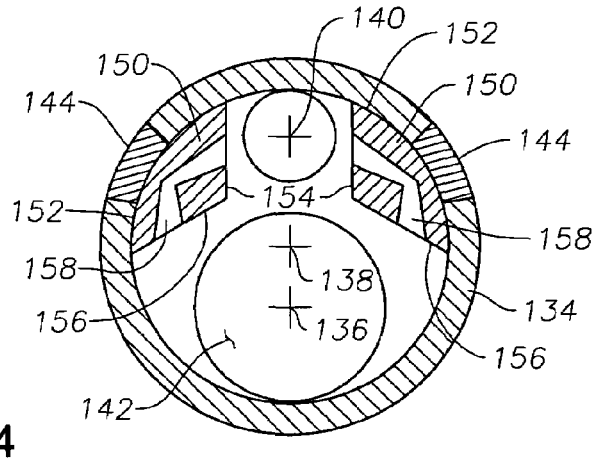
FIG. 14 is an axial cross-section taken along lines 14—14 of FIG. 13.
Figure 15:
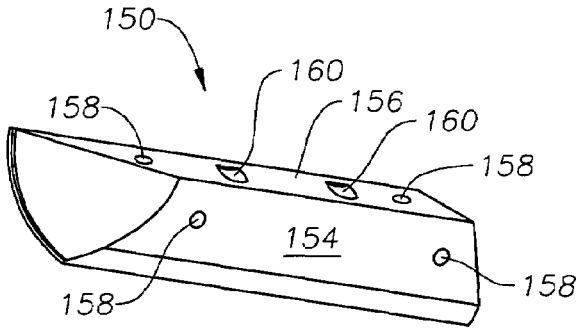
FIG. 15 shows an exemplary filler guide section used within the side-pocket mandrel shown in FIGS. 13 and 14.

The side pocket mandrel 118 is of the type described in our co-pending application Ser. No. 60/415,393, filed Oct. 2, 2002. The side pocket mandrel 118 is depicted in greater detail and apart from other components of the completion system in FIGS. 13, 14 and 15. The side pocket mandrel 118 includes a pair of tubular assembly joints 130 and 132, respectively, at the upper and lower ends. The distal ends of the assembly joints 130, 132 are of the nominal tubing diameter as extended to the surface and are threaded for serial assembly. Distinctively, however, the assembly joints 130, 132 are asymmetrically swaged from the nominal tube diameter at the threaded ends to an enlarged tubular diameter. In welded assembly, for example, between the enlarged diameter ends of the upper and lower assembly joints 130, 132 is a larger diameter pocket tube 134. Axis 136 respective to the assembly joints 130 and 132 is off-set from and parallel with the pocket tube axis 138 (FIG. 14).

A valve housing cylinder 140 is located within the sectional area of the pocket tube 134 that is off-set from the primary flow channel area 142 of the tubing string 110. External apertures 144 in the external wall of the pocket tube 134 laterally penetrate the valve housing cylinder 140. Not illustrated is a valve or plug element that is placed in the cylinder 140 by a wireline-manipulated device called a "kickover" tool. For wellbore completion, side pocket mandrel 118 is normally set with side pocket plugs in the cylinder 140. Such a plug interrupts flow through the apertures 144 between the mandrel interior flow channel and the exterior annulus and masks entry of the completion cement. After all completion procedures are accomplished, the plug may be easily withdrawn by wireline tool and replaced by a wireline with a fluid control element.

At the upper end of the mandrel 118 is a guide sleeve 148 having a cylindrical cam profile for orienting the kickover tool with the valve housing cylinder 140 in a manner well known to those of skill in the art.

Set within the pocket tube area between the side pocket mandrel valve housing cylinder 140 and the assembly joints 130 and 132 are two rows of filler guide sections 150. In a generalized sense, the filler guide sections 150 are formed to fill much of the unnecessary interior volume of the valve housing cylinder 140 and thereby eliminate opportunities for cement to occupy that volume. Of equal but less obvious importance is the filler guide section function of generating turbulent circulations within the mandrel voids by the working fluid flow behind a wiper plug.

Similar to quarter-round trim molding, the filler guide sections 150 have a cylindrical arcuate surface 152 and intersecting planar surfaces 154 and 156. The opposing face separation between the surfaces 154 is determined by clearance space required by the valve element inserts 150 and the kick-over tool.

Surface planes 156 serve the important function of providing a lateral supporting guide surface for a wiper plug as it traverses the side pocket valve housing cylinder 146 and keep the leading wiper elements within the primary flow channel 142.

At conveniently spaced locations along the length of each filler section 150, cross flow jet channels 158 are drilled to intersect from the faces 154 and 156. Also at conveniently spaced locations along the surface planes 154 and 156 are indentations or upsets 160. Preferably, adjacent filler guide sections 150 are separated by spaces 162 to accommodate different expansion rates during subsequent heat-treating procedures imposed on the assembly during manufacture. If deemed necessary, such spaces 162 may be designed to further stimulate flow turbulence.

FIG. 11 schematically illustrates an exemplary wiper plug 170 that is utilized with the completion system 100. A significant distinction this wiper plug 170 makes over similar prior art devices is the length. The length of the plug 170 is correlated to the distance between the upper and lower assembly joints 130 and 132. Wiper plug 170 has a central shaft 172 with leading and trailing groups of nitrile wiper discs 174. As is apparent from FIG. 11, the leading group of wiper discs 174 is located proximate the nose portion 176 of the shaft 172, while the trailing group of discs 174 is located proximate the opposite, or rear, end of the shaft 172. Each of the discs 174 surround the shaft 172 and have radially extending portions designed to contact the flowbore 114 and wipe excess cement therefrom. It is also noted that the discs 174 are concavely shaped so that they may capture pressurized fluid from the rear of the shaft 172. Between the leading and trailing groups is a spring centralizer 178.

As will be explained in further detail shortly, the design of the side pocket mandrel 118 is particularly useful in conjunction with the wiper plug 170 as the wiper plug 170 is pumped down the flowbore 114 to clean excess cement from the completion assembly 100. As the leading wiper group of discs 174 enters the side pocket mandrel 118, fluid pressure seal behind the wiper discs 174 is lost but the filler guide planes 156 keep the leading group of discs 174 in line with the primary tubing flow bore axis 136. The trailing group of discs 174 is, at the same time, still in a continuous section of tubing flow bore 142 above the side pocket mandrel 118. Consequently, pressure against the trailing group of discs 174 continues to load the plug shaft 172. As the wiper plug 170 progresses through the side pocket mandrel 118, the spring centralizer 178 maintains the axial alignment of the shaft 172 midsection. By the time the trailing group of discs 174 enters the side pocket mandrel 118 to lose drive seal, the leading group of discs 174 has reentered the flowbore 114 below the mandrel 118 and regained a drive seal. Consequently, before the trailing seal group of discs 174 loses drive seal, the leading seal group of discs 174 have secured traction seal.

Figure 6:
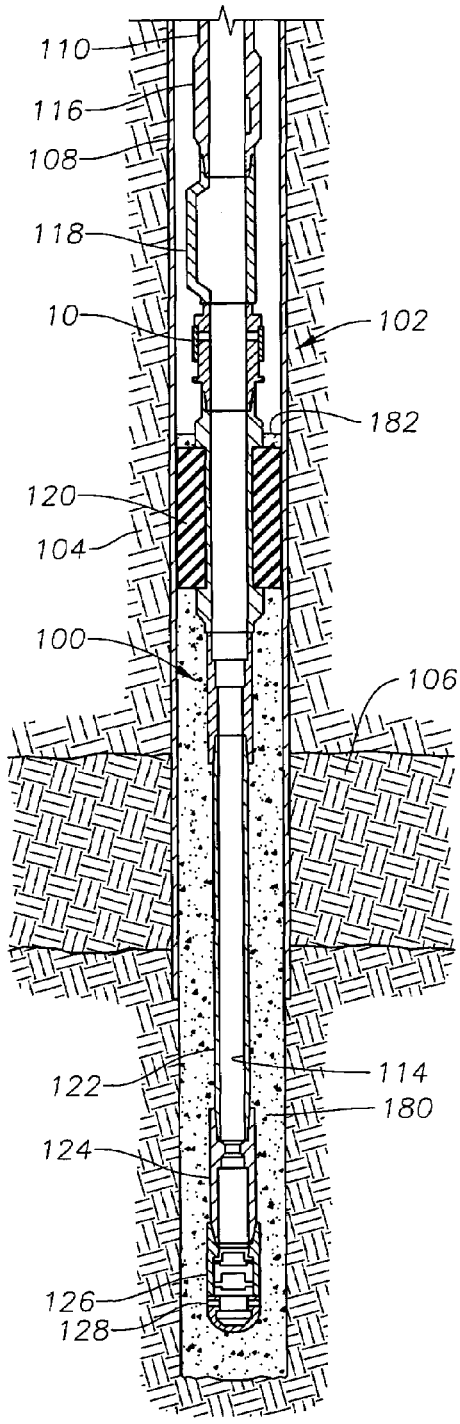
FIG. 6 is a side, cross-sectional view of the completion system shown in FIGS. 4 and 5 showing an included packer assembly actuated.
Figure 7:
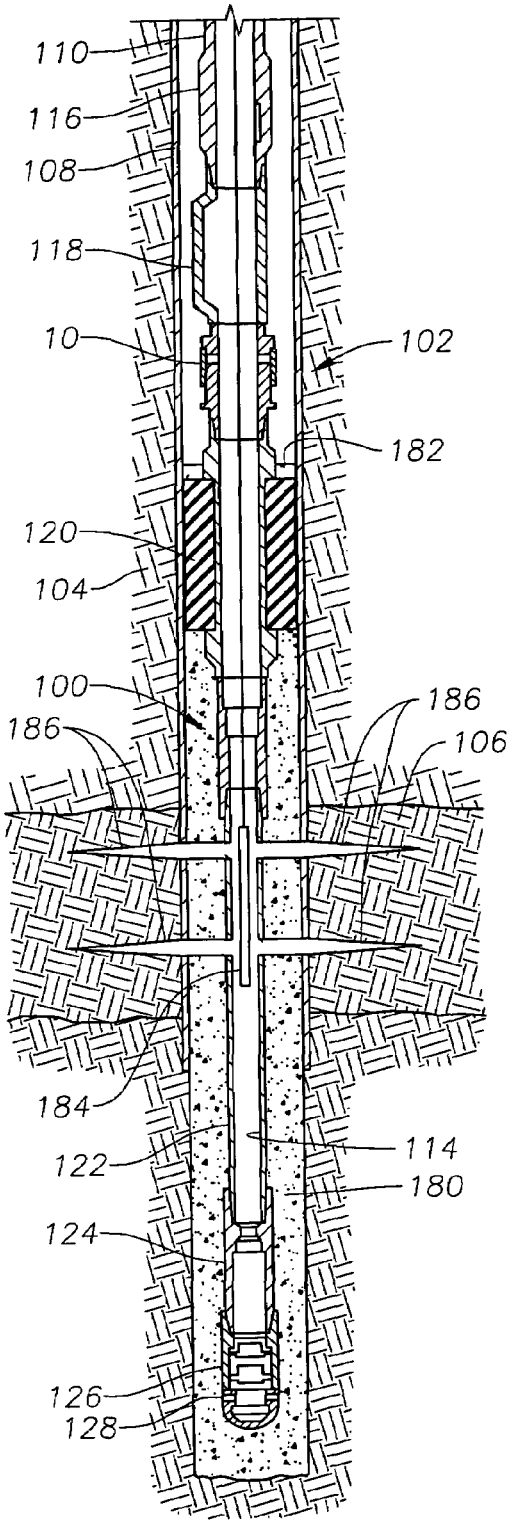
FIG. 7 is a side, cross-sectional view of the completion system shown in FIGS. 4–6 now with the surrounding formation having been perforated.

Exemplary operation of the overall completion system 100 containing the valve assembly 10 is illustrated by FIGS. 4-10. In FIG. 4, the assembly 100 is shown after having been disposed into the wellbore 102 so that the production liner 122 is located proximate the formation 106. Once this is done, cement 180 is flowed downwardly through the central flowbore 114 and radially outwardly through the lateral openings 128 in the shoe track 126. Cement 180 fills the annulus 112 until a desired level 182 of cement 180 is reached for anchoring the system 100 in the wellbore 102. Typically, the desired level 182 of cement 180 will be such that portions of the packer assembly 124 are covered (see FIG. 5). The packer assembly 124 is then set within the wellbore 102, as illustrated by FIG. 6 to complete the anchorage. Next, a perforation device 184, of a type known in the art, is run into the flowbore 114, as illustrated in FIG. 7. The perforation device 184 is actuated to create perforations 186 in the casing 108 and surrounding formation 106. The perforation device 184 is then withdrawn from the flowbore 114. If desired, the packer assembly 120 may be set after the perforation device 184 has been actuated and the cement cleaned from the system 100 in a manner which will be described shortly. Typically, the perforation device 184 is actuated to perforate the formation 106 after the cement 180 has been flowed into the wellbore 102 and the wiper plug 170 has been run into the flowbore 114, as will be described. Also, the cement 180 is typically provided time to set and cure somewhat before perforation.

Figure 8:
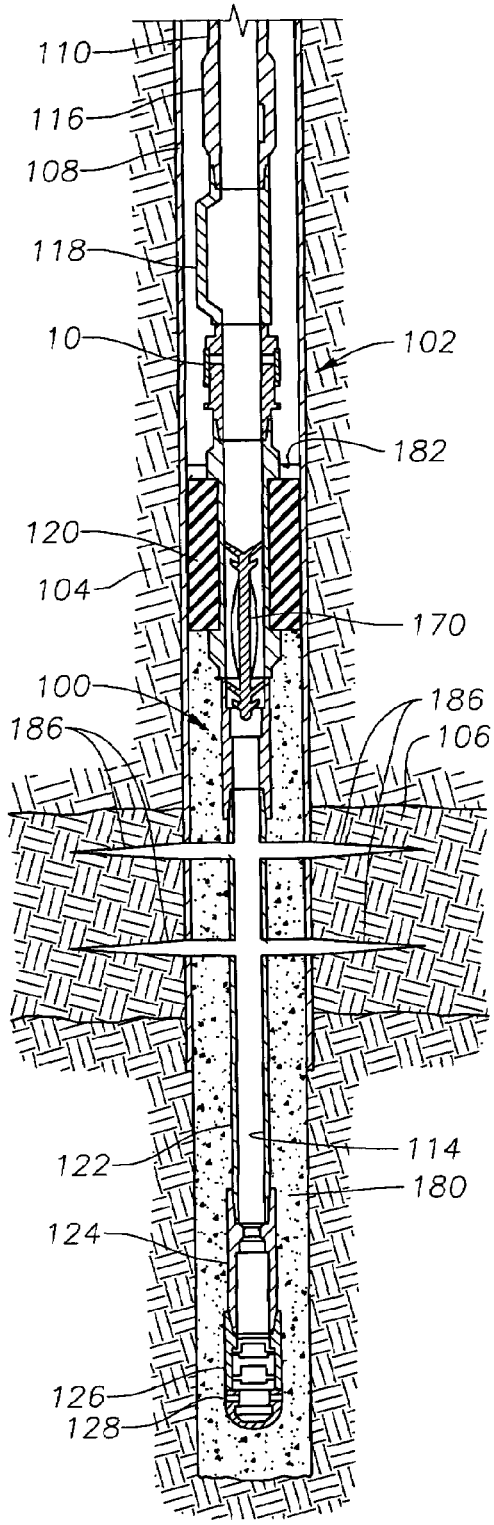
FIG. 8 is a side, cross-sectional view of the completion assembly shown in FIGS. 4–7 with a wiper plug being pumped down the flowbore.

Cement is cleaned from the system 100 by the running of the wiper plug 170 into the flowbore 114 to wipe excess cement from the flowbore 114 and the components making up the assembly 100. Thereafter, a well working fluid is circulated through the assembly 100 to further clean the components. As FIG. 8 illustrates, the wiper plug 170 is inserted into the flowbore 114 and urged downwardly under fluid pressure. A working fluid is used to pump the wiper plug 170 down the flowbore 114. Fluid pressure behind the discs 174 will drive the wiper plug 170 downwardly along the flowbore 114. Along the way, the discs 174 will efficiently wipe cement from the flowbore 114. When the wiper plug 170 reaches the lower end of the flowbore 114, it will become seated in the landing collar 124, as illustrated in FIG. 9.

FIG. 12 illustrates in greater detail,the seating arrangement of the wiper plug 170 in the landing collar 124. As shown there, the landing collar 124 includes an outer housing 190 that encloses an interior annular member 192. The annular member 192 provides an interior landing shoulder 194 and a set of wickers 196. The nose portion 176 of the wiper plug 170 lands upon the landing shoulder 194, which prevents the wiper plug 170 from further downward motion. The wickers 196 frictionally engage the nose portion 176 to resist its removal from the landing collar 124. Landing of the wiper plug 170 in the landing collar 124 will close off the lower end of the flowbore 114 to prevent further fluid flow outwardly via the shoe track 126.

Prior to running the completion system 100 into the wellbore 102, the HCCV assembly 10 is in the configuration shown in FIG. 1 with the outer sleeve 30 secured by shear pin 34 in an upper, open position upon the inner mandrel 12 so that the fluid flow port 32 in the outer sleeve 30 is aligned with the fluid port 26 of the inner mandrel 12. Once the wiper plug 170 has been landed in the landing collar 124, as described, the flowbore 114 will be closed at its lower end and, thereafter may be pressurized from the surface. Upon application of a first, suitable fluid pressure load within the flowbore 114, and, thus, the flowbore 18 of the HCCV assembly 10, the rupture disk 28 will be broken, thereby permitting fluid to be communicated between the flowbore 18 and the radial exterior of the HCCV assembly 10.

Figure 9:
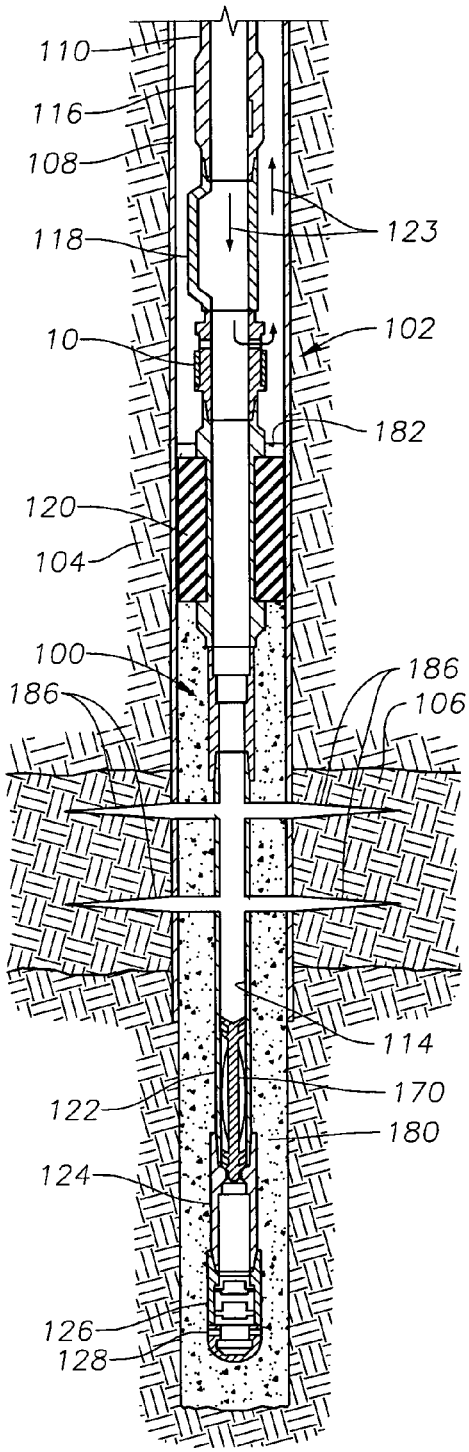
FIG. 9 is a side, cross-sectional view of the completion assembly shown in FIGS. 4–8 with the HCCV valve assembly in an open position for circulation of working fluid into the annulus following rupture of a frangible rupture member.

Once the rupture disc 28 has been destroyed, well working fluid can be circulated down the flowbore 114 and outwardly into the annulus 112 of the wellbore 102, as indicated by arrows 123 in FIG. 9. The working fluid may then return to the surface of the wellbore 102 via the annulus 112. As the working fluid is circulated into the flowbore 114 to the HCCV assembly 10, it is flowed through the side pocket mandrel 118. During this process, cement is cleaned from the completion system 100 by the flowing working fluid and, most particularly, from the side-pocket mandrel 118 so that it may be used for gas lift operations at a later point.

When sufficient cleaning has been performed, it is necessary to substantially close the fluid port 26 of the HCCV assembly 10 against fluid flow therethrough. The wellbore annulus 112 should be closed off at the surface of the wellbore 102. Thereafter, fluid pressure is increased within the flowbore 114 and the annulus 112 above the level 182 of the cement 180 via continued pumping of working fluid down the flowbore 114. Pumping of pressurized fluid should continue until a second, predetermined level of pressure is achieved. This predetermined level of pressure will act upon the upper end 36 of the outer sleeve 30 to shear the shear pin 34 and move the outer sleeve 30 to the closed position illustrated in FIG. 2. In this position, the outer sleeve 30 covers the fluid flow port 26 of the inner mandrel 12. Fluid communication between the flowbore 18 and the annulus 112 will be blocked. In this manner, circulation of a working fluid through the valve assembly 10, other portions of the completion system 100, and the annulus 112 may be selectively stopped. The flowbore 114 can then be pressure tested for integrity.

In the event of failure of the outer sleeve 30 to close, as desired, a wireline tool, shown as tool 200 in FIG. 3, having a shifter 202, which is shaped and sized to engage the profile 42 of the inner sleeve 38 in a complimentary manner, is lowered into the flowbore 114 and flowbore 18 of the valve assembly 10. When the shifter 202 engages the profile 42, the shifter 200 is pulled upwardly to move the inner sleeve 38 to its second, substantially closed position (shown in FIG. 3) so that the opening 40 on the inner sleeve 38 is not aligned with the flow port 26 of the inner mandrel 12. In this position, fluid flow through the flow port 26 is substantially blocked.

Following closure of the HCCV assembly 10, by either shifting of the outer sleeve 30 or inner sleeve 38, and pressure testing of the flowbore 114, hydrocarbon fluids may be produced through the flowbore 114 from the formation 106 under impetus of surface pumps (not shown) through the flowbore 114. At some point during the life of the wellbore 10, artificial lift may be needed or desired to assist production of fluids. The completion assembly 100 will accommodate such artificial lift measures due to the presence of the side pocket mandrel 118 and the techniques used to remove excess cement from the components of the completion assembly 100.

Figure 10:
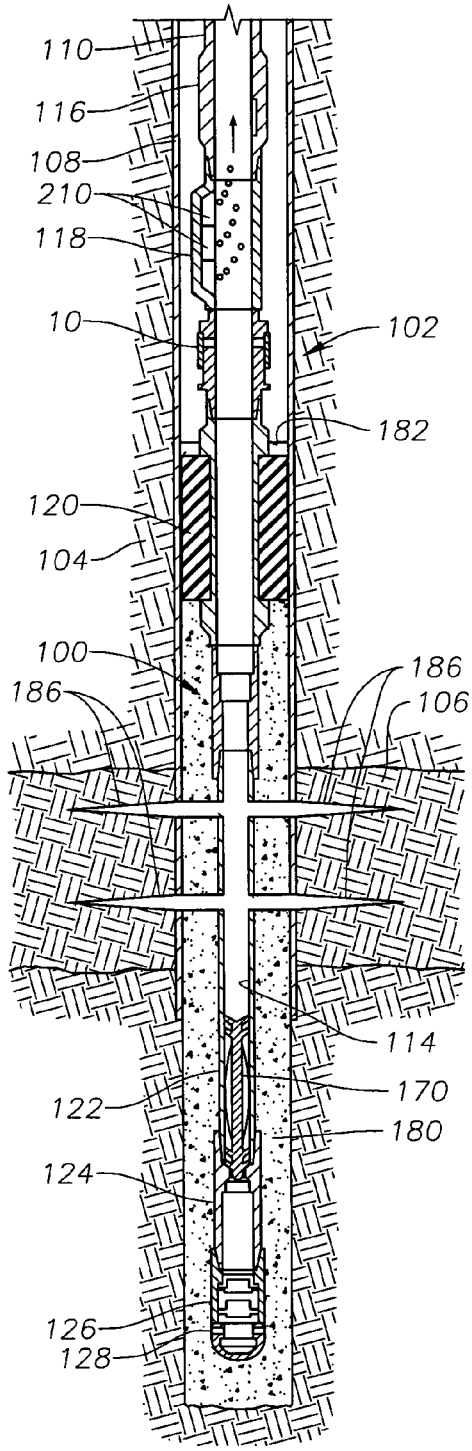
FIG. 10 is a side, cross-sectional view of the completion assembly shown in FIGS. 4–9 now with the HCCV valve assembly in a closed position and during subsequent production of hydrocarbon fluids.

FIG. 10 illustrates the addition of exemplary gas lift valves 210 into the side pocket mandrel 118 in completion system 100 in order to assist production of hydrocarbons from the formation 106. A kickover tool (not shown), of a type known in the art, is used to dispose one or more gas lift valves 210 into the cylinder 140 of the side pocket mandrel 118. The use of kickover tools is well known by those having skill in the art. Similarly, gas lift valves are well known to those of skill in the art and a variety of such devices are available commercially. Therefore, a discussion of their structure and operation is not being provided.

The gas lift valves 210 may be placed into the side pocket mandrel 118 and operable thereafter. The apertures 144 in the side pocket mandrel 118 should be substantially devoid of cement due to the measures taken previously to clean the completion system 100 of excess cement or prohibit clogging by cement. These measures include the presence of removable side pocket plugs in the cylinder 140 of the side pocket mandrel 118 and filler guide sections 150 with features to stimulate flow turbulence, including cross-flowjet channels 158 and spaces 162 between the guide sections 150. In addition, circulation of the working fluid throughout the system 100, in the manner described above, will help to clean excess cement from the side pocket mandrel 118, and other system components, prior to insertion of the gas lift valves 210.

After the gas lift valves 210 are placed into the side pocket mandrel 118, hydrocarbon fluids may be produced from the formation 106 by the system 100. Fluids exit the perforations 186 and enter the perforated production liner 122. They then flow up the flowbore 114 and into the production tubing 110. The gas lift valves 210 inject lighter weight gases into the liquid hydrocarbons, in a manner known in the art, to assist their rise to the surface of the wellbore 102.

Those of skill in the art will recognize that numerous modifications and changes may be made to the exemplary designs and embodiments described herein and that the invention is limited only by the claims that follow and any equivalents thereof.

What is claimed is:

1. A valve assembly for selectively providing fluid communication with a wellbore annulus comprising:

a completion string;

a tubular inner mandrel defining a flowbore within and having first and second ends disposed in the completion string;

a fluid flow port disposed within the inner mandrel to permit fluid communication between the flowbore and an annulus area radially exterior of the inner mandrel after the completion string has been at least partially cemented in the wellbore;

an outer sleeve radially surrounding the inner mandrel, the outer sleeve being moveable with respect to the inner mandrel between a substantially open position, wherein the outer sleeve substantially does not block the fluid flaw port, and a substantially closed position, wherein the outer sleeve substantially does block the fluid flow port; and a frangible rupture member disposed within the fluid flow port, the rupture member being rupturable in response to a first level of fluid pressure within the flowbore.

2. The valve assembly of claim 1 further comprising an inner sleeve contained within the flowbore of the inner mandrel, the inner sleeve being moveable between a substantially open position, wherein the inner sleeve substantially does not block the fluid flow port, and a substantially closed position, wherein the inner sleeve substantially does block the fluid flow port.

3. The valve assembly of claim 1 wherein the outer sleeve presents a pressure-receiving area so that an increase of fluid pressure upon the pressure receiving area moves the outer sleeve from the substantially open position to the substantially closed position.

4. The valve assembly of claim 2 wherein the inner sleeve presents a profile for selective engagement by a shifter in order to axially move the inner sleeve from the substantially open position to the substantially closed position.

5. The valve assembly of claim 1 wherein the outer sleeve presents an axially-located pressure receiving area, and the outer sleeve is moveable between the substantially open and substantially closed positions in response to a second level of fluid pressure upon the pressure receiving area.

6. The valve assembly of claim 5 wherein the outer sleeve is selectively secured to the inner mandrel by a frangible pin that is broken upon application of the second level of fluid pressure to the pressure-receiving area.

7. A system for cleaning excess cement from a completion assembly in conjunction with a cementing operation and to prepare the completion assembly for production of hydrocarbons from a formation, the system comprising:

a completion string;

a flowbore defined along the length of the completion string along which cement or hydrocarbon fluids may be flowed;

a valve assembly incorporated into the completion string for providing selective fluid communication between the flowbore and an annular space surrounding the completion assembly after the completion string has been at least partially cemented in the wellbore; and a flow device selectively closing a lower end of the flowbore from fluid flow.

8. The system of claim 7 wherein the flow device comprises a plug member that is landed in a complimentary landing seat within the flowbore.

9. The system of claim 8 wherein the plug member comprises a wiper plug having at least one wiper disc for wiping of excess cement from the completion string.

10. The system of claim 7 wherein a first level of fluid pressure within the flowbore selectively opens the valve assembly.

11. The system of claim 7 wherein a second level of fluid pressure within the flowbore and the annular space closes the valve assembly.

12. The system of claim 7 wherein the valve assembly is substantially closable by a shifting tool.

13. The system of claim 7 wherein the valve assembly includes a fluid flow opening that provides for fluid communication between the flowbore and the annular space, the fluid flow opening being initially closed by a frangible rupture member that will rupture upon application of a first fluid pressure level to the valve assembly.

14. The system of claim 7 wherein the valve assembly comprises:

an inner mandrel containing a lateral fluid flow opening; and a first sleeve that is moveable with respect the inner mandrel to selectively open and close the fluid flow opening to fluid flow therethrough.

15. The system of claim 14 wherein the first sleeve is moveable in response to fluid pressure that is applied to the valve assembly.

16. The system of claim 14 wherein the valve assembly further comprises a second sleeve that is moveable with respect the inner mandrel to selectively open and close the fluid flow opening to fluid flow therethrough.

17. The system of claim 16 wherein the second sleeve is manually actuatable by means of a shifting tool.

18. A method for operating a valve assembly having an axial flowbore and incorporated within a wellbore completion system, the method comprising:

at least partially cementing a completion string in the wellbore;

applying a first level of fluid pressure to the valve assembly disposed along the completion string to open a fluid flow port in the valve assembly;

circulating well working fluid into the flowbore, through the fluid flow port, and into an annular space radially surrounding the valve assembly; and applying a second level of fluid pressure to the valve assembly to close the fluid flow port.

19. The method of claim 18 wherein the step of applying a first level of fluid pressure to open the fluid flow port further comprises rupturing a frangible rupture member.

20. The method of claim 18 wherein the step of applying a second level of fluid pressure to close the fluid flow port further comprises moving a sleeve of the valve assembly.

21. The method of claim 18 further comprising manually closing the fluid port in the event that the second level of fluid pressure fails to close the fluid flow port.

* * * * *